US007901304B1

(12) United States Patent
Moore

(10) Patent No.: US 7,901,304 B1
(45) Date of Patent: Mar. 8, 2011

(54) GOLF TEACHING DEVICE

(76) Inventor: Randy L. Moore, Sandusky, OH (US)

( * ) Notice: Subject to any disclaimer, the term of this patent is extended or adjusted under 35 U.S.C. 154(b) by 0 days.

(21) Appl. No.: 12/639,447

(22) Filed: Jan. 15, 2010

Related U.S. Application Data

(63) Continuation-in-part of application No. 11/739,252, filed on Apr. 24, 2007, now abandoned.

(51) Int. Cl.
*A63B 69/36* (2006.01)

(52) U.S. Cl. ..... 473/409; 473/160; 473/279

(58) Field of Classification Search ..... 473/157, 473/160, 161, 162, 167, 168, 181, 270, 273, 473/278, 279, 409
See application file for complete search history.

(56) References Cited

U.S. PATENT DOCUMENTS

| | | | | |
|---|---|---|---|---|
| 4,037,847 | A * | 7/1977 | Lorang | 473/269 |
| 4,917,385 | A * | 4/1990 | Brown | 473/273 |
| 5,000,457 | A * | 3/1991 | Brown | 473/273 |
| 5,263,863 | A * | 11/1993 | Stefani et al. | 473/269 |
| 6,623,370 | B1 * | 9/2003 | Willer | 473/169 |

* cited by examiner

*Primary Examiner* — Nini Legesse
(74) *Attorney, Agent, or Firm* — Jerry Semer

(57) ABSTRACT

The training device is made in two pieces that are mirror image of each other. In the first embodiment which is used to improve an individual's general swing the two pieces are laid together such that the two inclines form a valley. To use the device one steps on the inclines and places his feet approximately shoulder length apart in parallel with the valley. One then takes up a stance to swing. As he practices swinging the golf club he noticed how his body feels with the weight on the insides of his feet. By him standing on the inclines he will keep his feet, hips, shoulders in the proper position for a correct swing.

4 Claims, 8 Drawing Sheets

GOLF TEACHING DEVICE

This application is a continuation-in-part of prior application Ser. No. 11/739,252 that was filed on Apr. 24, 2007.

FIELD OF INVENTION

This invention relates to the field of golf devices for improving one's game, and more particularly to golf devises for improving one's stance, balance, and swing.

FIELD OF INVENTION

Golf is from one of the most popular sports in the world. Almost everyone in the country has picked up a set of golf clubs and tried his hand at playing golf. Most of us do not play well. There are few who have the skill of Tiger Woods. But even the poorest of golfers is very competitive. They are always trying many different ways to improve their game. Many golfers take lessons. Other golfers try different devices on the market to make them better players. There is a huge number of different devices on the market to make an individual a better golfer. This is evident by the many patents in this area.

This invention relates to a device that is design to improve one's swing, balance, and the one's stance. Many experts say that improving one's swing and balance is the most important aspect of improving one's golf game. Clearly, most great golfers have a great swing. Only one great golfer in modern times was known for his bad swing. That's Arnold Palmer. Sam Snead's great swing kept him playing competitive pro golf until he was into his 70s. Thus, one of the objectives of this invention is to create a device that will help an individual improve his swing. In order to have a better swing, one has to have a balanced stance. Thus, another object to this invention is to create a device that will help an individual improve his balanced stance.

The inventor believes that in order for an individual to learn a certain physical action, he must learn the feelings of that physical action. He believes that your muscles must learn how an action feels to learn to do an action. Thus, the inventor has devised a device that not only causes the golfer to take the proper stance, but to get the proper feeling and the proper weight distribution, in order to make a perfect swing. The golfer stands on the device and can feel the proper weight distribution upon his feet. As he turns back in his swing, he feels the weight upon his feet shifting. This ensures that he will swing with a near perfect swing. Therefore, by keeping the weight on his feet properly, he will be able to produce a near perfect swing. By using the training device he will teach his muscles the proper feeling of weight distribution so that when he gets to the golf course and takes his next swing, his muscles will remember the proper position and feeling, and thus will be able to re-create the perfect swing.

SUMMARY OF THE INVENTION

The training device is made in two pieces that are mirror image of each other. These two pieces are placed together for golfers to help golfers improve their stance and swing. In the first embodiment which is used to improve an individual's general swing the two pieces are laid together such that the two inclines form a valley. The inclines are of a size that an individual can stand with his feet shoulder length apart and each foot will be in approximately in the middle of both inclines. When the individual is standing with his feet parallel to the valley and in the middle of both inclines approximately shoulder length apart the individual will find that the weight of his body rests on the balls or inside of his feet. This is the position for the weight of the body to rest throughout the entire golf swing. To use the device one steps on the inclines and places his feet approximately shoulder length apart in parallel with the valley. One then takes up a stance to swing. As he practices swinging the golf club he noticed how his body feels with the weight on the insides of his feet. By him standing on the inclines he will keep his feet, hips, shoulders in the proper position for a correct swing.

DETAILED DESCRIPTION OF THE PREFERRED EMBODIMENT

Figure 1:
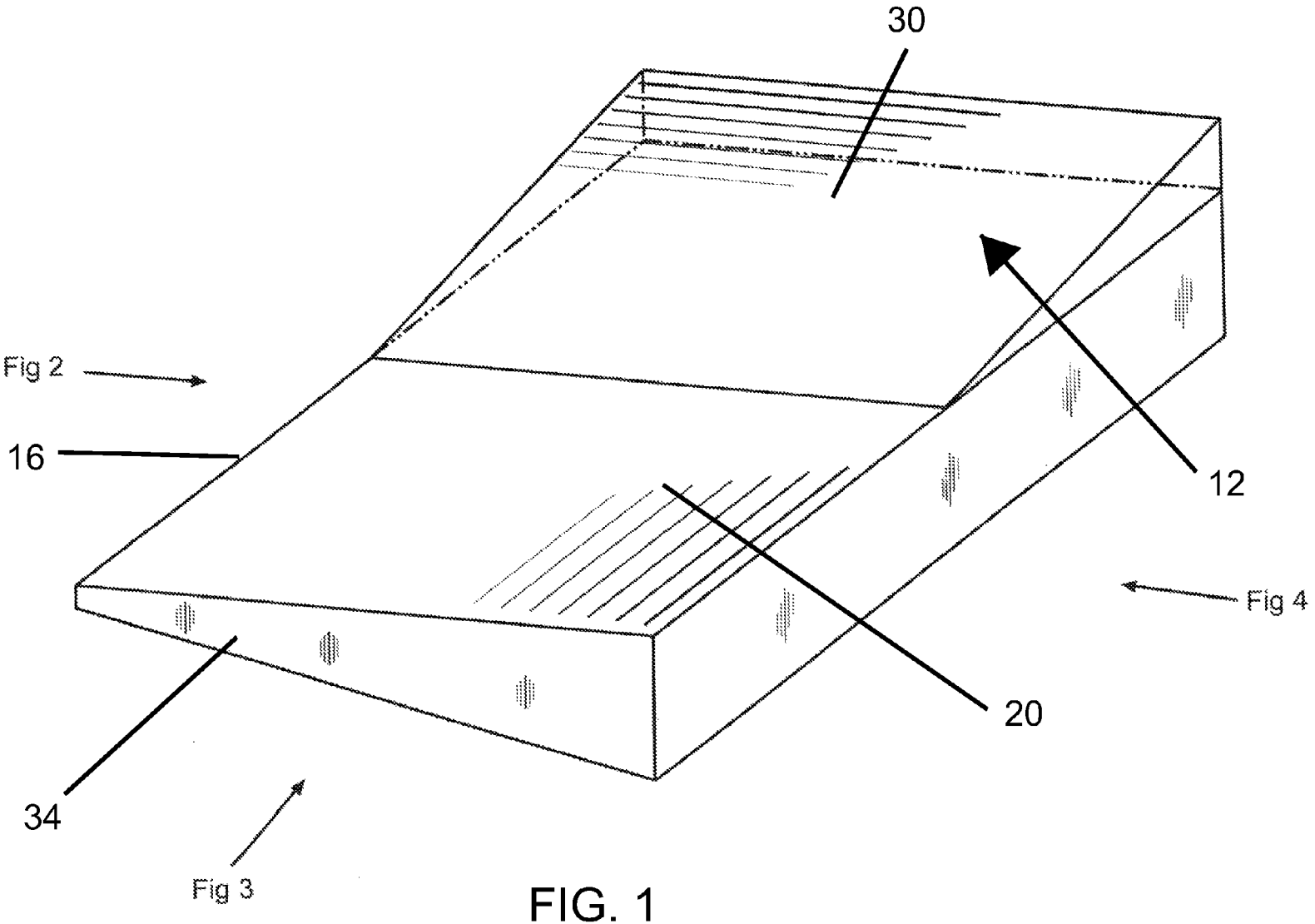
FIG. 1 is a perspective view of one of the two pieces that create the invention.
Figure 5:
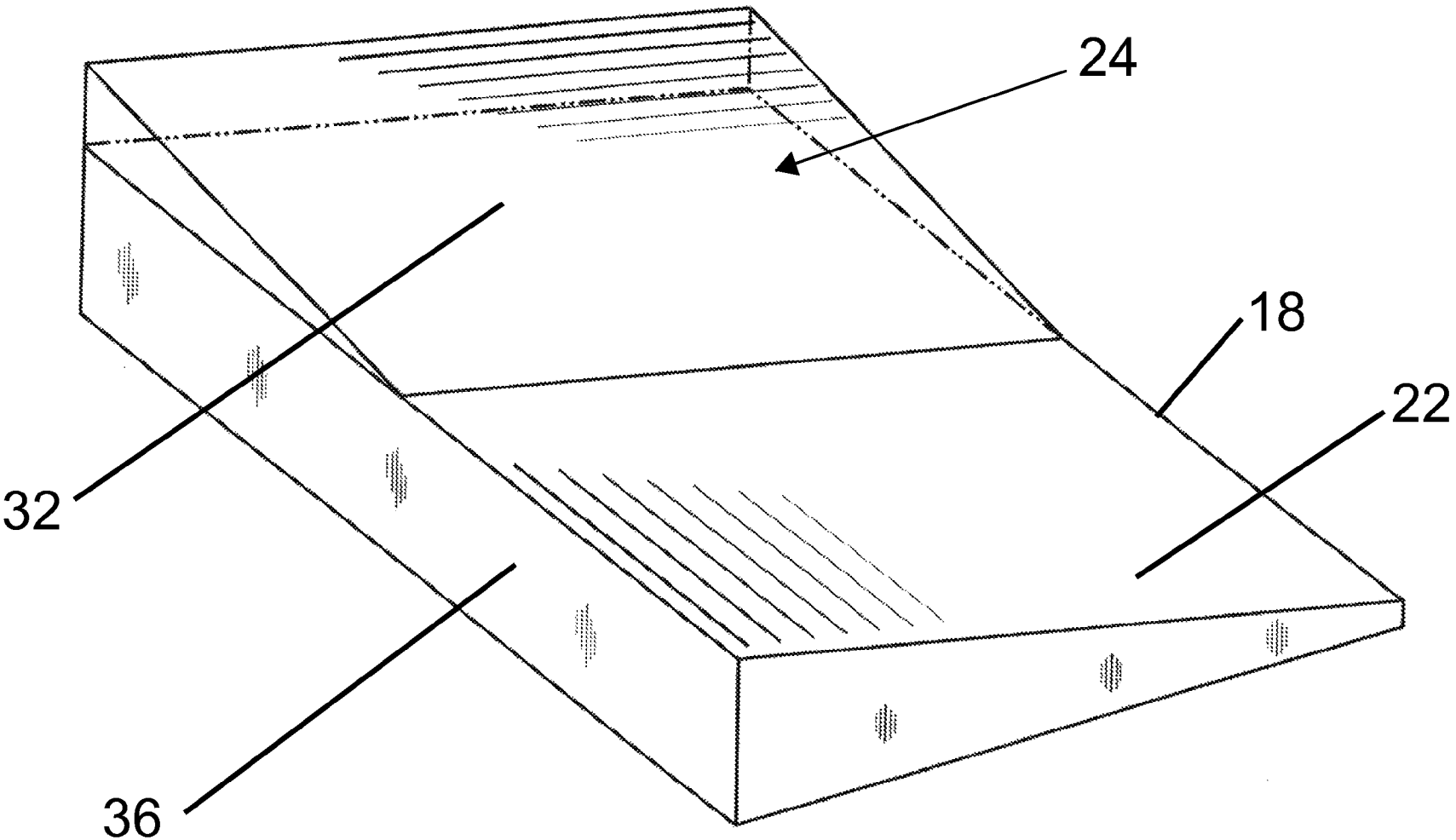
FIG. 5 is a perspective view of the other pieces that create the invention.

The invention is made in two pieces 12 and 14. Piece 14 is the mirror image of piece 12 as shown in FIGS. 1 and 5. The two pieces can be made out of wood, plastic, metal or any other material that is sufficiently strong to hold a person. A perspective view of piece 12 is shown in FIG. 1 and a perspective view of piece 14 is shown in FIG. 5. The invention is a training device which consists of two pieces 12 and 14 placed together that help golfers improve their stance and swing. In the first embodiment which is used to improve an individual's general swing the two pieces 12 and 14 are laid together so that side 16 on piece 12 is against side 18 on piece 14. This creates two inclines 20 and 22 that form a valley. The inclines 20 and 22 are of a size that an individual with his feet shoulder length apart can stand with one foot on incline 20 and one foot on incline 22 and each foot will be in approximately in the middle of the inclines 20 and 22. The angle of the incline and size of the piece can vary according to the individual who is being trained. When the individual is standing with his feet parallel to the valley and in the middle of both inclines 20 and 22 approximately shoulder length apart the individual will find that the weight of his body rests on the balls or inside of his feet. This is the position for the weight of the body to rest throughout the entire golf swing.

Figure 2:
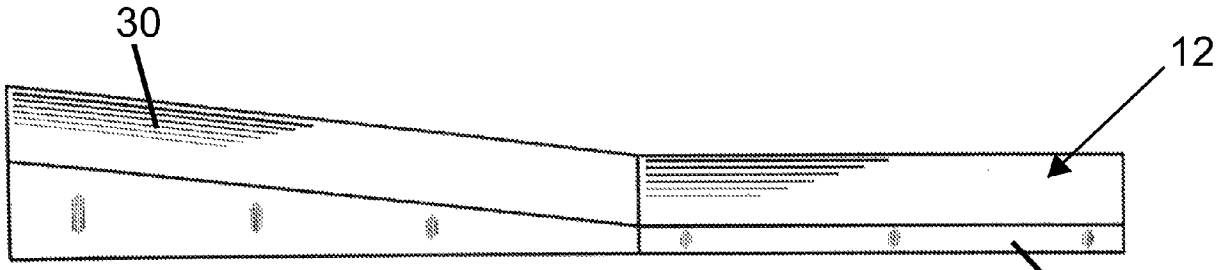
FIG. 2 is a side view of one of the two sides of one of the two pieces that create the invention.
Figure 7:
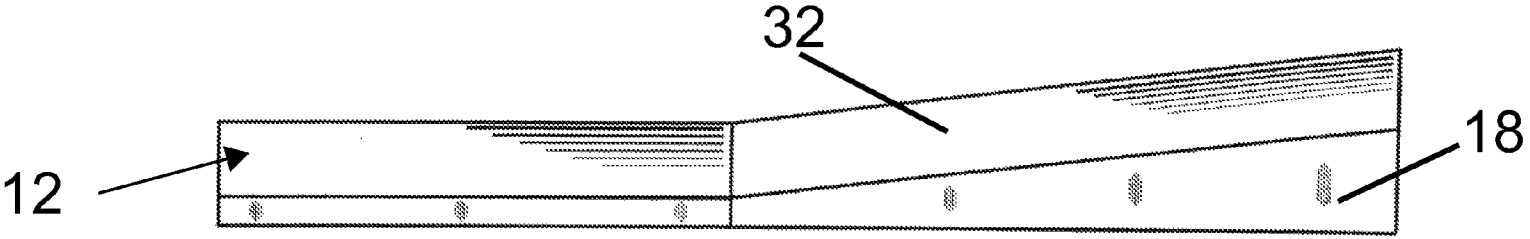
FIG. 7 is a side view of the other sides of the other piece that create the invention.
Figure 8:
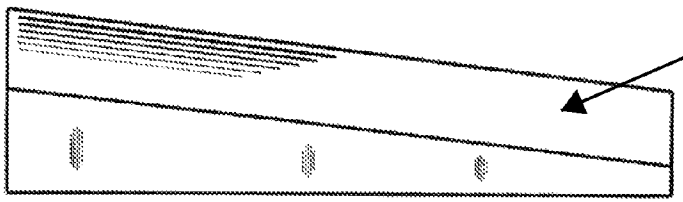
FIG. 8 is a front view of one of the two pieces that create the invention.
Figure 9:
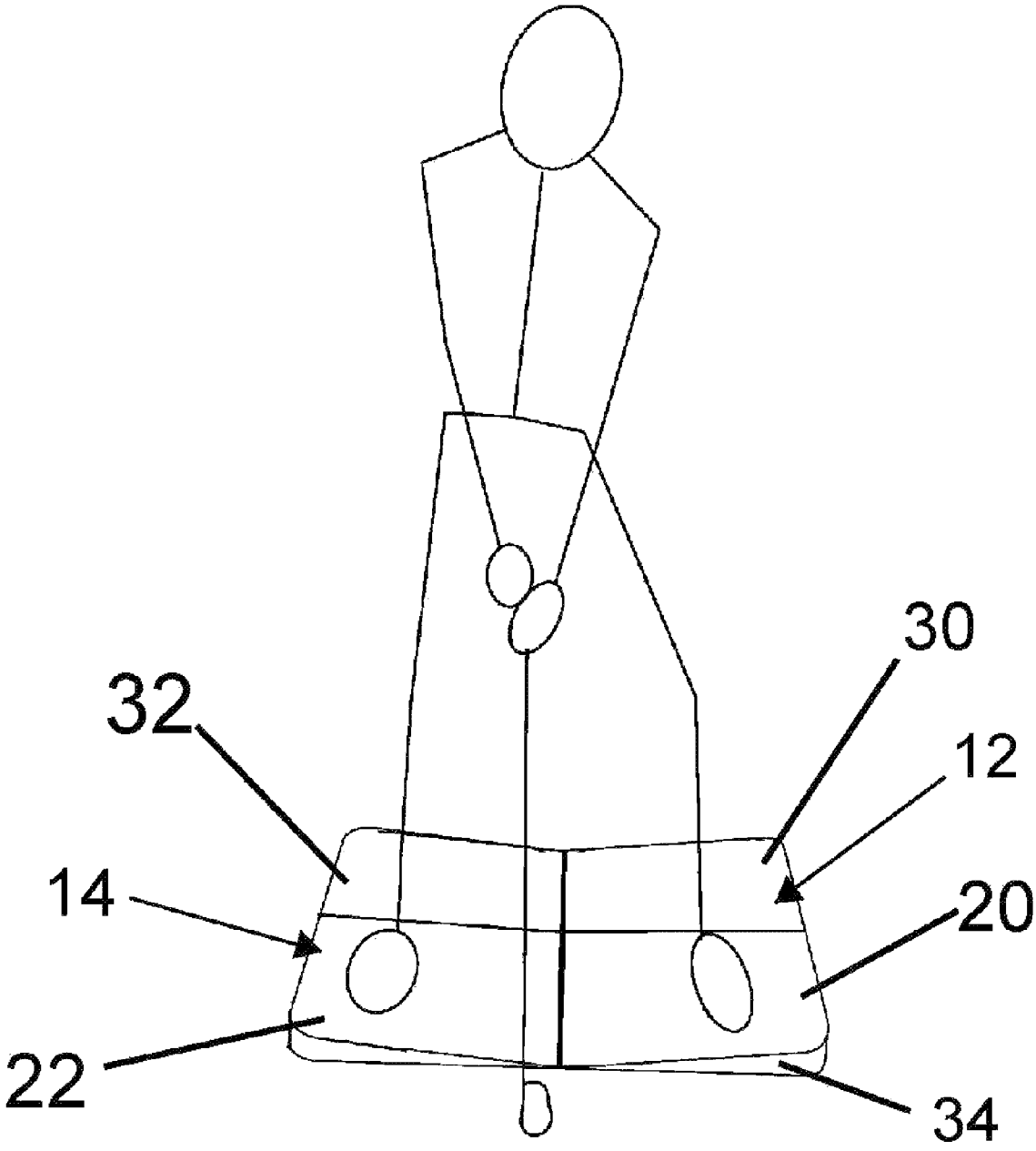
FIG. 9 is a view of an individual practicing his swing with the members positioned for the first embodiment of the invention.

To use the invention one steps on the pieces 20 and 22 and places his feet parallel with the valley formed by the two inclines 20 and 22 being placed together along side 16 on FIGS. 1 and 2 and side 18 on FIGS. 5 and 7. An individual then begins to take his golf swing. When one is standing on the incline 16 and 18 the weight of one body is placed on the golfer's balls of his feet or the inside of his foot as shown in FIG. 9. This is exactly where the weight of the body should be throughout the entire golf swing. Thus, by standing on the inclines 20 and 22 and taking swings one learns where the weight should be positioned. Then when an individual goes out to play his round of golf he will remember where his weight should be placed and his swing will improve just by him placing the weight on the balls of his feet.

By keeping the weight on the balls of his feet the individual not only learns the feeling of where the weight should be placed but the individual's body also learns how it should feel during the perfect swing. By being on the incline 20 and 22, the individual will also keep his feet in proper position throughout the entire swing. The incline 20 and 22 and the weight on the balls of your feet keeps a person in position as he swings back to begin his stroke of the ball. Then, by keeping his weight on the balls of his feet as he swings forward, he will be in perfect position to hit the ball and follow through with twisting his body properly by keeping the weight on the balls of his feet. This is done very easily when one swings on the incline 20 and 22 since the incline forces the individual to keep the weight on the balls of his feet. As he practices his swing on the inclines 20 and 22 he will prefect not only the perfect swing but learn how to balance himself throughout the swing and learn how the perfect swing feels.

The individual golfer should keep his weight on the balls of his feet throughout the entire swing. As he raises up to position himself to begin his swing, the weight should be on the balls of his feet. As he gets to the highest point the weight should be on the balls of his feet. As he swings down towards the ball, the weight should be on the balls of his feet and as he follows through the weight should be on the balls of his feet. By keeping the weight on the balls of his feet during follow through he will not be able to hook or slice the ball by fading away or fading towards the ball. The device not only causes the person to take a perfect swing by standing upon it but it also teaches him where his weight should be throughout the swing. And after a few hours of practice, it also teaches his muscles to automatically take the position so that he can get the perfect swing out on the golf course.

Figure 4:
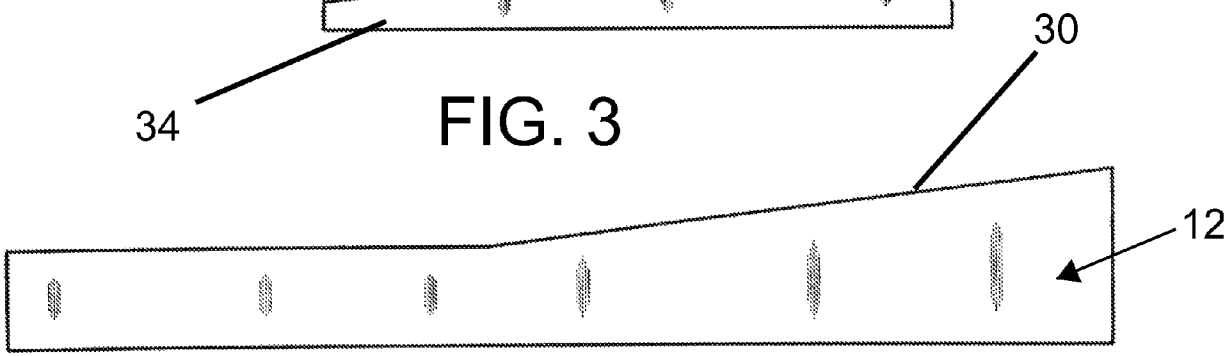
FIG. 4 is a side view of the side opposite the side of FIG. 2.
Figure 6:
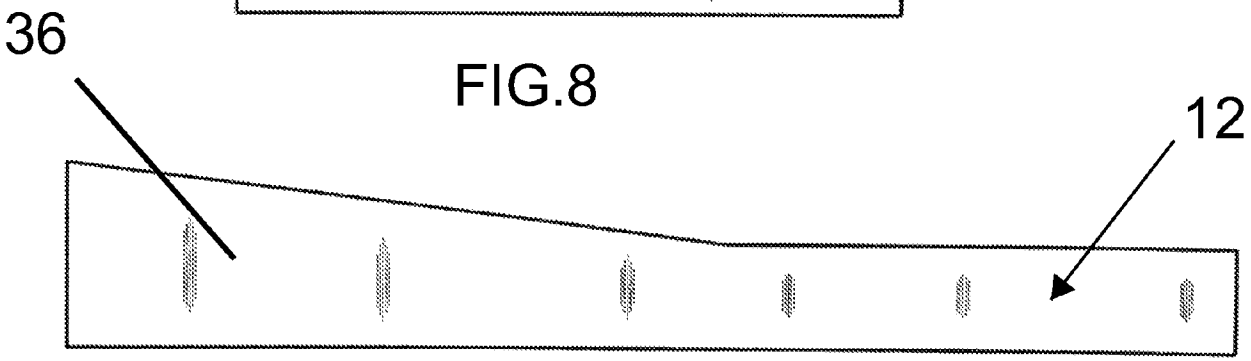
FIG. 6 is a side view one of the sides of the other piece that create the invention.
Figure 10:
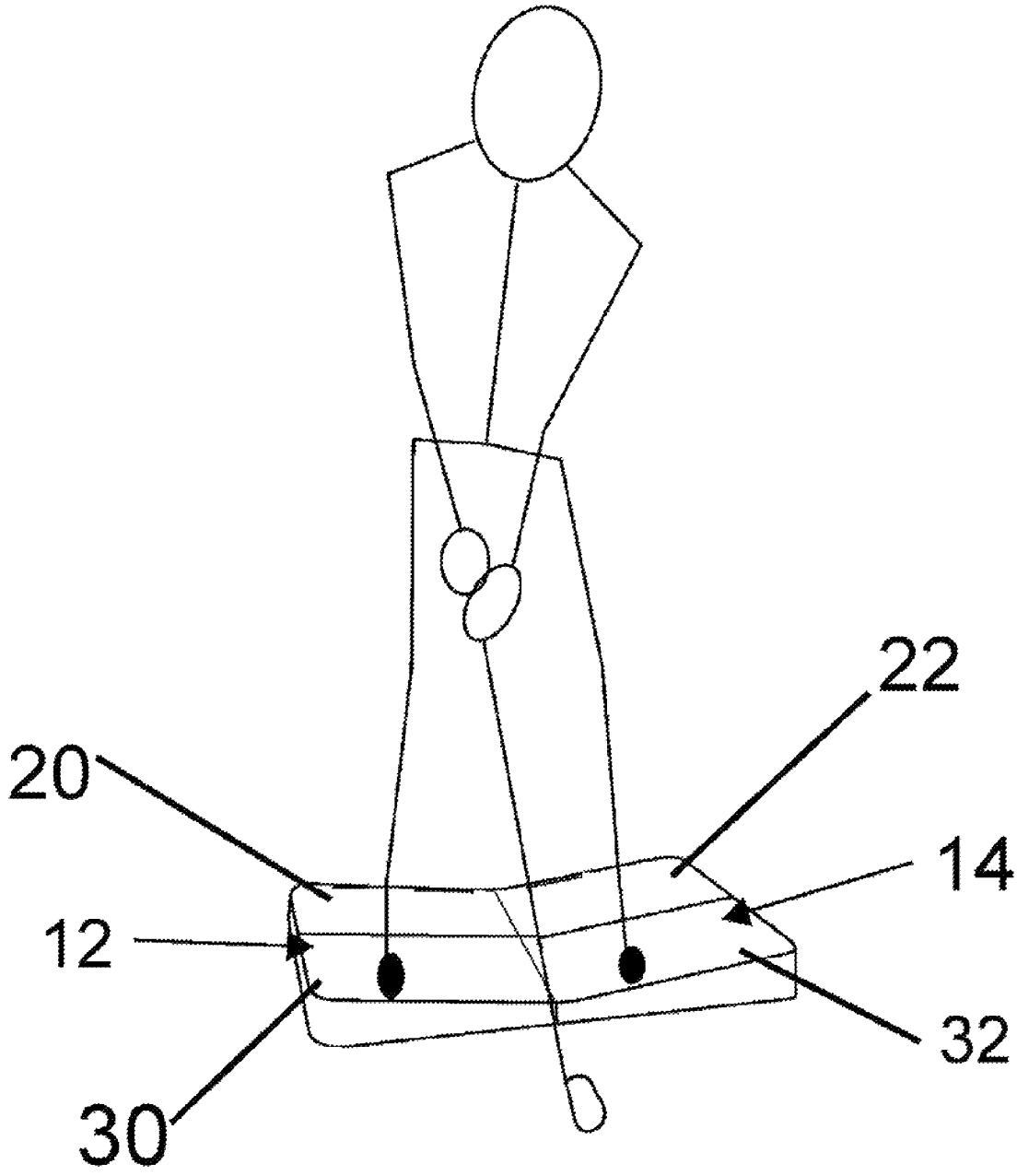
FIG. 10 is a view of an individual practicing his swing with the members in position for an uphill lie.

In the second embodiment the two pieces 12 and 14 are placed along side 16 on FIGS. 1 and 4 and side 14 on FIGS. 5 and 6 just as in the previous embodiment. The up incline 30 on FIGS. 1 and 4 and the up incline 32 on FIGS. 2 and 6 are place against each other. The up incline 32 and 30 are rectangular wedge shaped prisms that are integrally added to the inclines 20 and 22. Thus up inclines 32 and 30 when placed as stated above not only incline upward, but also downward toward a valley between the up inclines 32 and 30. Thus when the golfer stands on the up inclines 30 and 32 shown in FIG. 10 he will not only fill the uphill incline but also the weight on the balls of his feet.

Figure 11:
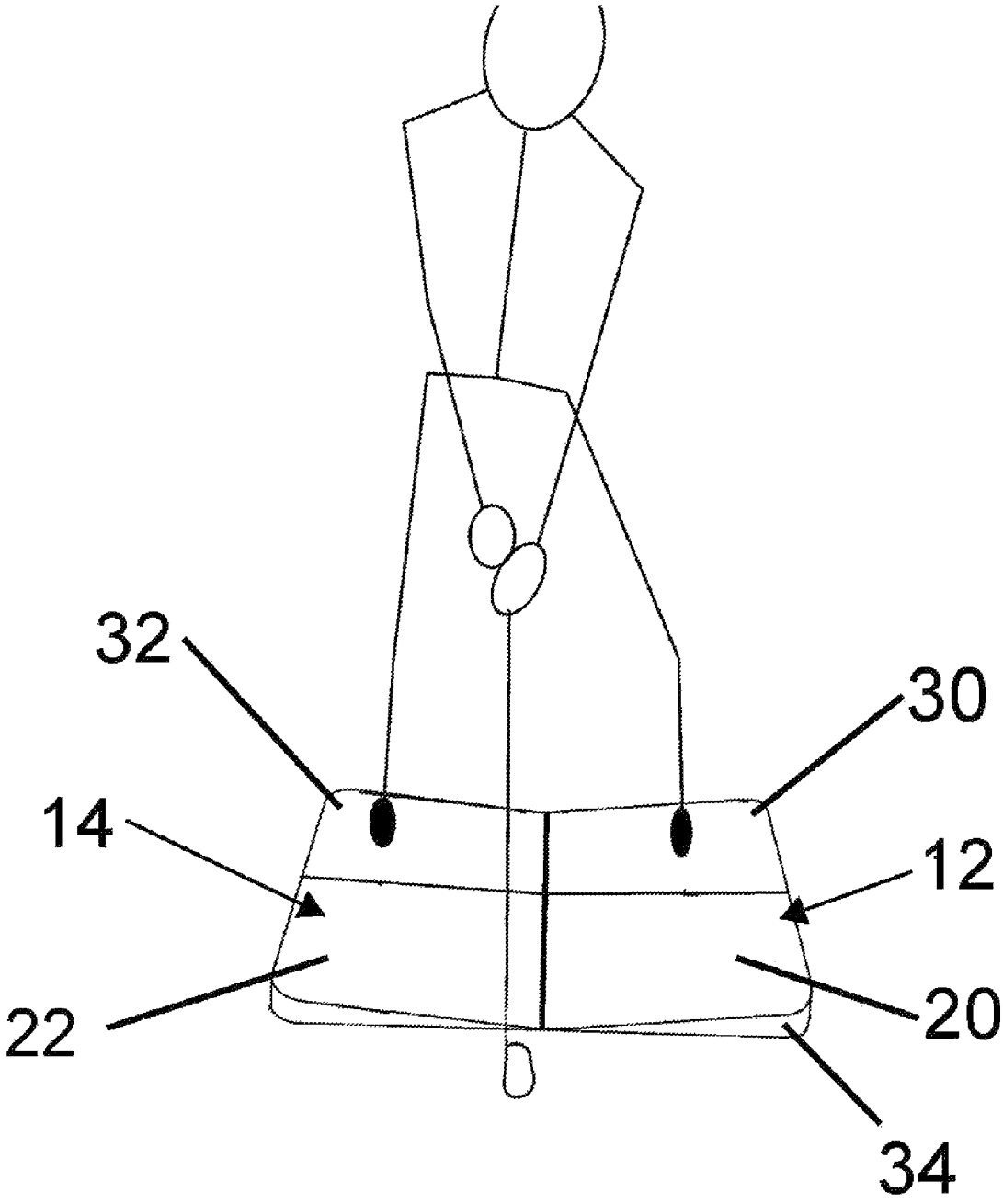
FIG. 11 is a view of an individual practicing his swing with the members in position for a downhill lie.

To practice an uphill lie, the golfer steps onto the up inclines 30 and 32 with the inclines 20 and 22 behind him and place is feet shoulder length apart as he does for a normal stance. He then take his swings. This gives him the feel of what his swing should be like when he is on an uphill lie. By taking practice swings in this position he will learn the proper balance for an uphill lie. If he turns around and faces the inclines 20 and 22, and places his feet in the position on the up incline 30 and 32 of his normal golf swing and take a few swings as shown in FIG. 11. He is now simulating a down hill lie. Thus, by using the two pieces 12 and 14 he is able to learn them feeling and balance of a perfect swing for a uphill lie and a down hill lie.

Figure 3:
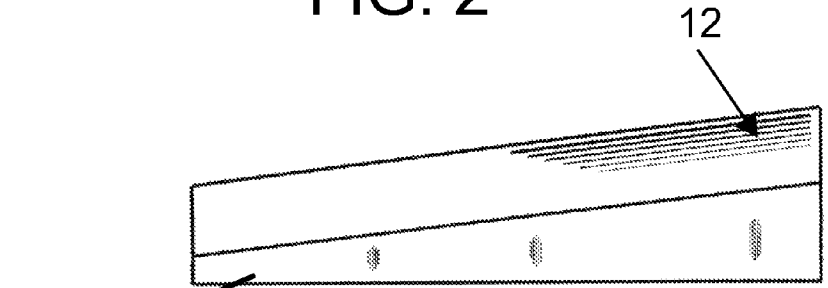
FIG. 3 is a front view of one of the two pieces that create the invention.
Figure 12:
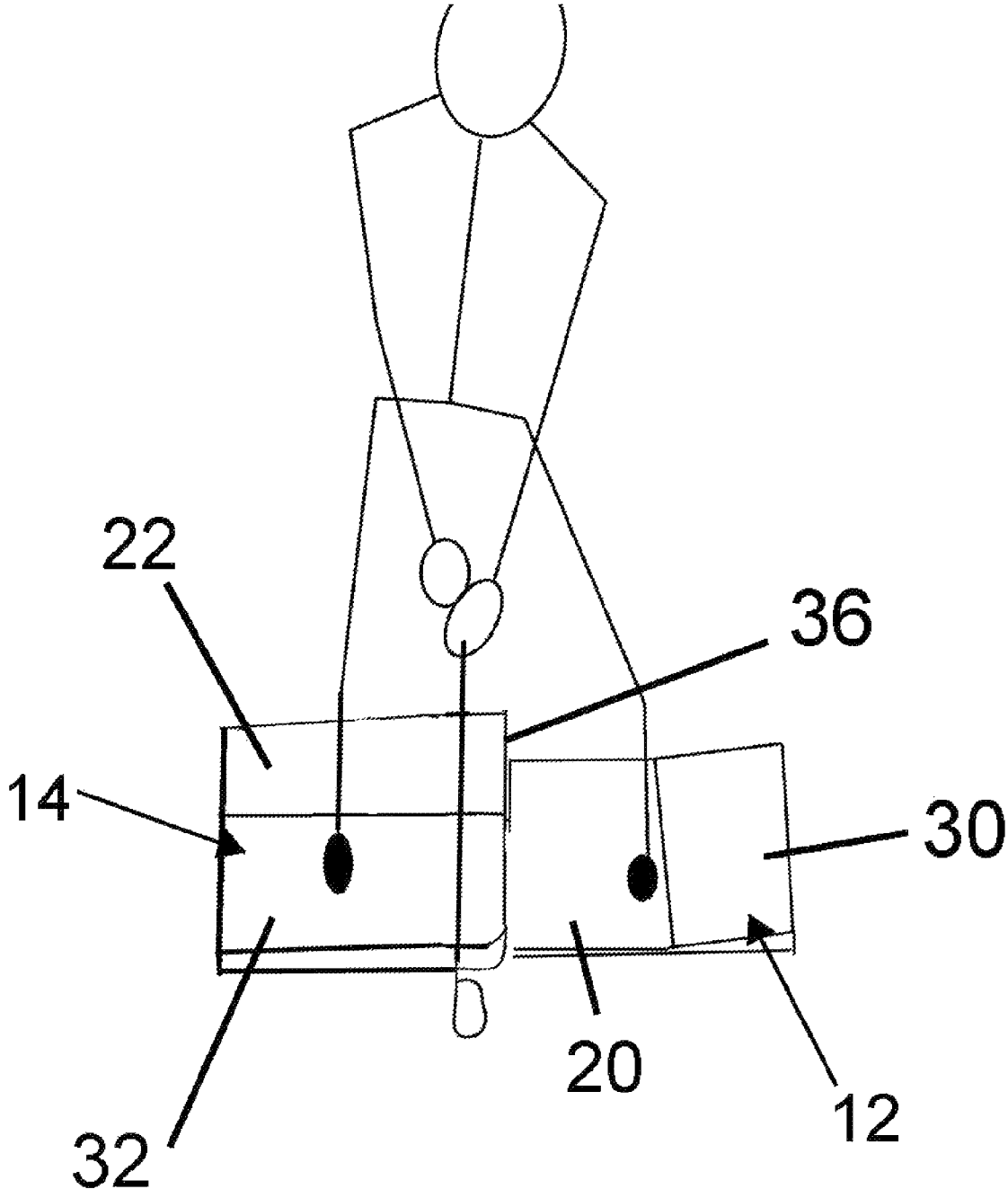
FIG. 12 is a view of an individual practicing his swing with the members in position for an uneven lie.

A golfer's lie is sometimes on an uneven surface. This can also be simulated by the two pieces 12 and 14. If one places piece 12 side 34 as shown in FIGS. 1 and 3 along side 36 shown in FIGS. 2 and 6 one lines up the incline 20 on piece 12 with the up incline 32 of the other piece 14. To simulate an uphill or down hill lie on an uneven surface one would take a normal golf stance with one foot on the incline 20 and the other on the up incline 32 as shown in FIG. 12. If one is facing the incline 20 on the piece 12, one would be simulating a downhill lie on an uneven surface. In this embodiment the foot on the incline 20 would be lower than the foot on the up incline 32. By taking practice swings in this position one would be learning the feel for hitting a golf ball on an uneven surface.

I claim:

1. A method of practicing a proper golf swing comprising the steps of:

a. placing one foot on a first member and said first member has a first incline and a second incline and said second incline on the first member is a wedge shaped prism that is added to the first incline of the first member and slants both upward and to the side and placing one's other foot on a second member with a first incline and a second incline and said second incline on the first member is a wedge shaped prism that is added to the first incline of the second member and slants both upward and to the side and said first and second members are setting side by side and placing the feet approximately should length apart; and, b. practicing ones golf swing, having ones feet, hips shoulder in the correct position due to the first incline of the first and second members; and, c. learning to feel the weight of ones body on the balls of his feet, and the feel of the proper golf swing.

2. A method of practicing a proper golf swing as in claim 1 wherein:

a. the first incline of the first member and the first incline of the second member facing each other to form a valley where the first and second inclines make contact with each other; and, b. the placing ones foot on the first incline of the first member and one foot on the first incline of the second member and said feet are parallel to the valley.

3. A method of practicing a proper golf swing as in claim 1 further comprising:

a. placing the second inclines of both the first and second members side by side with the second incline of the first member and the second incline of the second member facing each other to form a valley where the second inclines of both members make contact with each other; and, b. the placing of ones foot on the second incline of the first member and ones foot on the second incline of the second member and said feet are parallel to the valley; and, c. learning to feel one's weight of one's body on ones balls of ones feet for an uphill or downhill lie.

4. A method of practicing a proper golf swing as in claim 1 further comprising the steps of:

a. placing said first incline on the first member alongside the second incline of the second member such that the first incline of the first member is lower than the second incline of the second member; and, b. the placing of one's feet on the first and second members with one foot on the first incline of the first member and one foot on the second incline of the second member and said feet are parallel to the line formed by the junction of the first and second members; and, c. learning to feel one's weight of one's body on one's balls of one's feet for an uneven lie.

* * * * *